complemental detent means engaged, respectively, at said stable positions.

3. Apparatus in accordance with claim 2 wherein said inwardly facing walls of said posts are concave, and the side wall portions of said segment juxtaposed to said inner walls are convex, said concave and convex surfaces defining said detent means and being disposed in nested position at said stable positions and being substantially unstable at any intermediate position.

* * * * *

United States Patent [19]

Dibble et al.

[11] 4,023,389

[45] May 17, 1977

[54] METHOD OF FLOW FORMING

[75] Inventors: Gordon L. Dibble, Fontana; Stewart T. Russell, Hawthorne, both of Calif.

[73] Assignee: Rockwell International Corporation, El Segundo, Calif.

[22] Filed: June 16, 1976

[21] Appl. No.: 696,606

[52] U.S. Cl. ..... 72/38; 72/353; 72/357; 72/364

[51] Int. Cl.² ..... B21B 9/00; B21D 22/00

[58] Field of Search ..... 72/356, 357, 360, 353, 72/342, 364, 38, 399

[56] References Cited

UNITED STATES PATENTS

| | | | |
|---|---|---|---|
| 2,515,841 | 7/1950 | Stuart | 72/360 |
| 3,680,381 | 8/1972 | Portal | 72/357 |
| 3,750,450 | 8/1973 | Sharp | 72/353 |

*Primary Examiner*—Leon Gilden
*Attorney, Agent, or Firm*—Charles T. Silberberg

[57] ABSTRACT

A metal preform is flow formed into a desired structure utilizing segmented dyes. The metal preform is positioned in a chamber comprised of shaping members which define a surface substantially complementary to the desired structure. At least two of the shaping members are spaced from one another and define a groove therebetween. The preform is heated to a temperature suitable for superplastic forming and then compressed such that the preform deforms against the shaping members and into the groove. The at least two spaced shaping members are forced to move into contiguous relationship thereby reducing the size of the groove while forcing further deformation of the preform into the groove.

7 Claims, 3 Drawing Figures

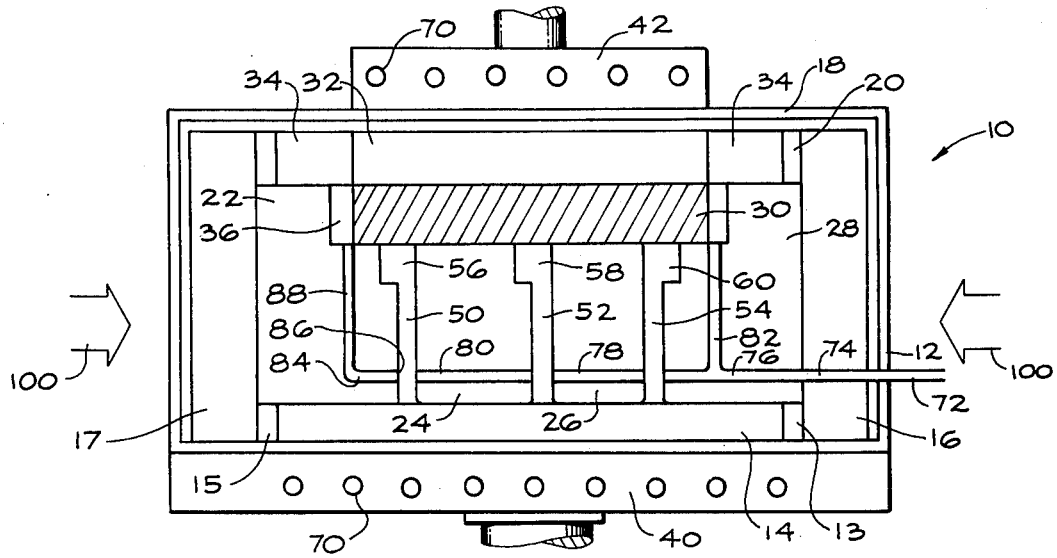

METHOD OF FLOW FORMING

BACKGROUND OF THE INVENTION

The present invention relates to a process for flow forming. Existing manufacturing techniques for forming a desired structure from a preform often require substantial machining of the shape or joining together of a number of parts to form the desired structure. This normally results in wastage of material of the preform, extra processing steps, and a possibly weakened structure at the joint of a plurality of preforms. This results in undesirable increased costs and time consumption in processing the preform.

The present invention relates to a process where parts are formed to substantially net shape to thereby reduce conventional machining and obivate the need where possible for a plurality of parts which must be joined to form the final structure. Flow forming is a process where a part is formed by the use of heat and compressive pressure. It is to be distinguished from superplastic forming where parts are drawn under tensile stress. The part to be formed is placed within tooling and heated to the temperature at which the part material becomes plastic. Pressure is then applied to the tooling to flow the part material into the shape dictated by the tooling.

A method seeking to overcome the aforementioned disadvantages of the prior art is described in U.S. Pat. No. 3,519,503 to Moore, et al. In this method high strength alloys are heated to a temperature placing them in a condition of low strength and high ductility and forged in hot dyes to a desired shape. However, structures requiring large deformation are either not possible or excess time consumption is required for flow of the preform to the desired shape. Additionally, problems result in removing the formed part from the structure.

SUMMARY OF THE INVENTION

It is, therefore, an object of the present invention to successfully deform a metal preform to substantially net shape where substantial deformation of the prefrom is required.

It is another object of the present invention to reduce the forming time in flow forming.

It is yet another object of the present invention to flow form in a substantially contamination free environment.

It is still another object of the present invention to alleviate the problem of removal of the formed structure from the tooling.

Briefly, in accordance with the invention, there is provided an improved method of flow forming a metallic structure from a preform. A pluraltiy of shaping members are positioned to define a chamber surrounding the preform. The chamber defines a surface substantially complementary to the desired final shape of the preform. At least two of the shaping members which define a portion of the surface are spaced from one another and also define a groove therebetween. The preform is heated to a temperature suitable for flow-forming and compressed by application of pressure to deform against the shaping members and into the groove. The at least two shaping members are forced to move into contiguous relationship to reduce the size of the groove to the desired dimensions and thereby force the preform to further deform into the groove.

In a particular embodiment of the invention the preform is of a wrought material and a substantially contamination free environment is provided within the chamber. Optimally, the preform is compressed by application of isostatic pressure through the shaping members.

Other objects and advantages of the invention will become apparent upon reading the following detailed description and upon reference to the drawings.

While the invention will be described in connection with the preferred embodiment, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

Figure 1:
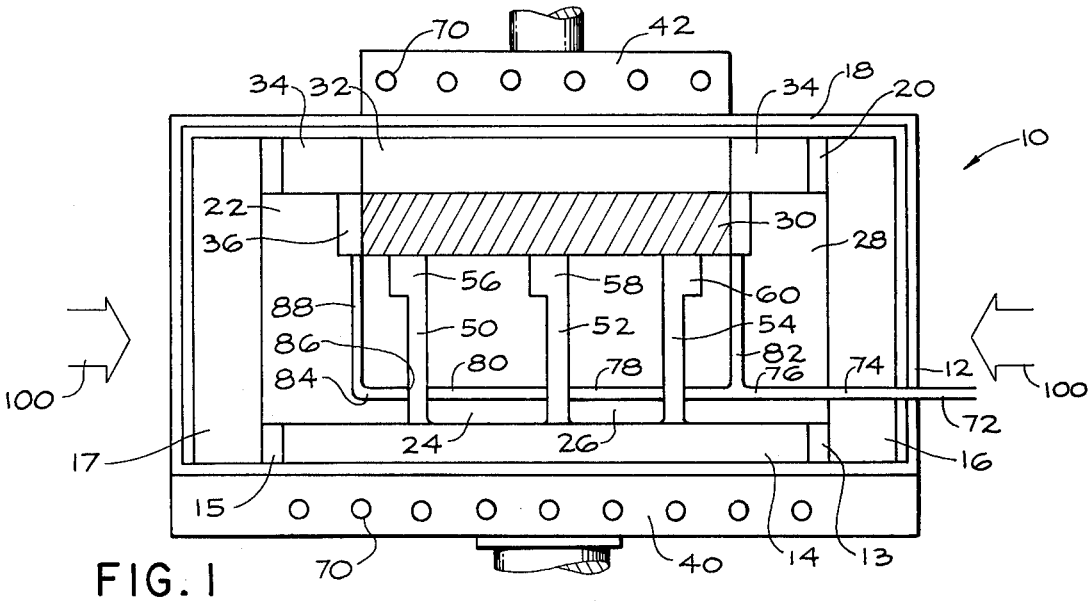
FIG. 1 is a cross sectional elevational view of the basic flow forming apparatus employed in the present invention showing the preform before forming.
Figure 2:
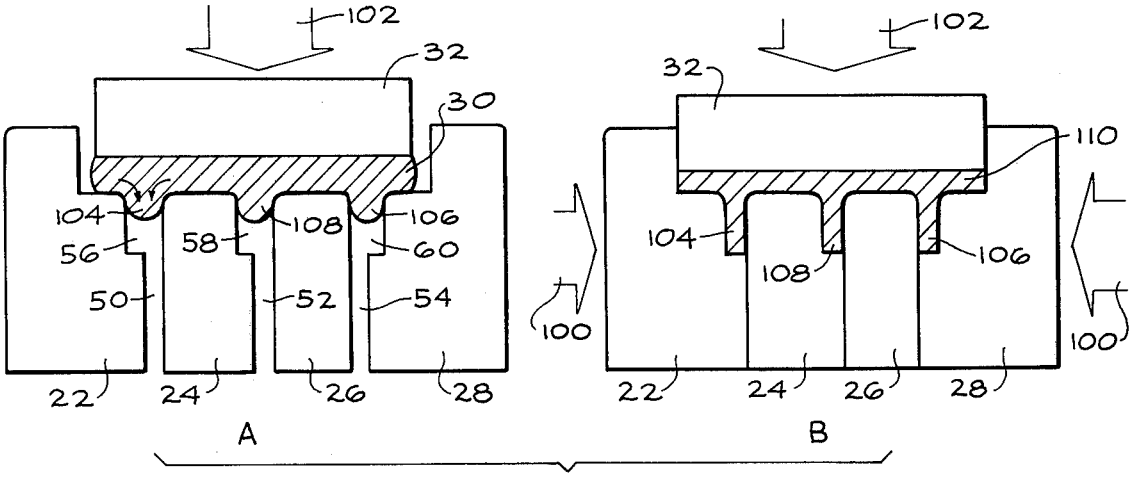
FIG. 2 is a diagramatic illustration of the preform and shaping members in an intermediate stage of the forming process at A and the final position of the part as formed at B.

Referring now to FIG. 1, there is shown an example of a forming apparatus generally indicated at 10 for carrying out the present invention. A retort 12 is preferably provided as a housing for the forming apparatus 10. Within the retort is optimally provided a base plate 14 and vertically extending support frames 16 and 17 positioned on opposite sides of base plate 14. Support frames 16 and 17 are spaced from base plate 14 as shown at 13 and 15. Additional support frames (not shown) could be provided as where there would be four separate support frames, each being positioned on the respective sides of base plate 14.

Frame members 16 and 17 along with base plate 14 and the lid 18 of retort 12 define a cavity 20 in which tooling members 22, 24, 26, and 28, along with preform 30, punch 32 and side blocks 34 are positioned. Tooling members 22, 24, 26, and 28, along with punch member 32 (also a tooling or shaping member), are designed and arranged to form a chamber 36 such that the surface of chamber 36 is substantially complementary to the desired final shape of preform 30. Punch 32 and tooling members 22, 24, 26, and 28 act as shaping members for preform 30. While not shown, any of the aforementioned shaping members can have protuberances on its surface contacting preform 30 which in the forming of preform 30 would act as a male dye member. Blocks 34 act as a positioning guide for punch 32 and also as a stop mechanism for tooling frames 16 and 17 (base plate 14 also acts as such a stop mechanism).

A primary consideration in selection of a suitable shaping member alloy is reactivity with the metal to be formed at forming temperature. When the metal to be formed is titanium or an alloy thereon, iron base alloys with low nickel content and modest carbon content (as 0.2 – 0.5% carbon) have been successful. Additionally, creep strength and mechanical properties can also be considered.

Figure 3:
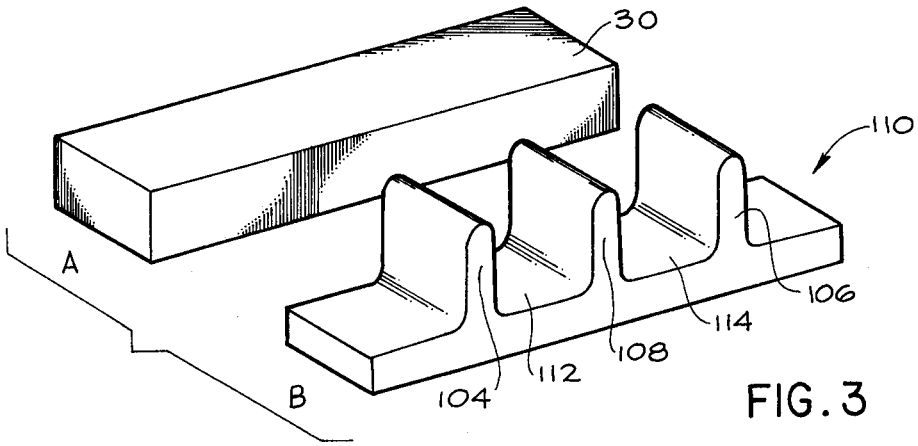
FIG. 3 is a perspective view of the preform at A and the fully formed structure at B.

Preform 30 can be in a variety of forms such as billet, bar stock, sheet stock, plate stock, rod, pellets, or combinations of these forms. In FIGS. 1 and 3A there is shown a plate stock preform 30 which normally would have a fairly substantial thickness such that superplastic forming utilizing a differential gas pressure would not be practical due to the large forming time required or where the desired final shape would be particularly difficult for such a process. Any metal capable of sufficient plastic deformation under compressive pressure at obtainable economical temperatures, but preferably one that exhibits suitable superplastic properties can be used for preform 30, but the present invention is particularly concerned with such metals that are subject to the contamination at forming temperatures, such as titanium or an alloy thereof such as Ti-6A1-4V. The advantage of a superplastic material is that the flow stresses are lower at lower strain rates which can thereby often permit reduced pressures to cause flow forming (albeit at lower strain rates). Preform 30 is optimally a wrought material as the flow forming process would normally not effect a working of the preform, i.e., no mechanical property improvement results. The extent to which any material selected will exhibit superplastic properties is predictable in general terms from a determination of its strength and strain rate sensitivity and a design determination of the permissible variation in wall thickness. Strain rate sensitivity can be defined as $m$ where $m = (d \ln \sigma / d \ln \epsilon)$ and $\sigma$ in stress in pounds per square inch and $\epsilon$ is strain rate in reciprocal minutes. Strain rate sensitivity may be determined by a simple and now well recognized torsion test described in the article: "Determination of Strain — Hardening Characteristics by Torsion Testing," by D. S. Fields, Jr., and W. A. Backofen, published in the proceedings of the ASTM, 1957, Vol. 57, pages 1259–1279. A strain rate sensitivity of about 0.5 or greater can be expected to produce satisfactory results, with the larger the value (to a maximum of 1) the greater the superplastic properties.

The initial thickness of preform 30 is determined by the dimensions of the part to be formed. Certain variables have been found to affect strain rate sensitivity of the flow stress and therefore should be considered in selecting a suitable metal material. Decreasing grain size results in correspondingly higher value for strain rate sensitivity and lower available flow stress. Additionally, strain rate and material texture affect the strain rate sensitivity.

Once the forming apparatus has been properly arranged relative to preform 30 within retort 12 and the lid 18 of retort 12 welded shut, forming apparatus 10 is placed in a press between press platens 40 and 42. In the embodiment illustrated in FIG. 1, platen 40 acts as support for the forming apparatus and prevents movement of the forming apparatus while pressure is applied by platen 42 to compress preform 30. Suitable retaining members (not shown) are provided along the lateral sides of the retort 12 to prevent movement of the forming apparatus in any of those directions.

Shaping members 22, 24, 26, and 28 are segmented and spaced from one another as shown at 50, 52, and 54 thereby increasing the size of grooves 56, 58, and 60 respectively. The total width of spacings 50, 52, and 54 optimally is substantially the same as the total width of spacings 13 and 15 such that closing of spaced 13 and 15 by inward movement of tooling frames 16 and 17 also close spaces 50, 52, and 54. Shaping members 22 and 24 define groove 56, shaping members 24 and 26 define groove 58, and shaping members 26 and 28 define groove 60. Segmenting and spacing dye members 22, 24, 26 and 28 in this fashion allows for greater deformation of preform 30 into grooves 56, 58 and 60, shorter forming time, and ease in removal of the finally formed structure as more fully described hereinafter.

Maximum strain rate sensitivity in metals is seen to occur, if at all, as metals are deformed near the phase transformation temperature, which varies with parameters such as grain structure and composition of the preform. Accordingly, the temperature immediately below the phase transformation temperature can be expected to produce the greatest strain rate sensitivity. For titanium and its alloys, the temperature range which optimal flow forming characteristics can be observed is about 1450° F to about 1850° F, depending upon the specific alloy used. For Ti-6AL-4V, a temperature of about 1700° F is normally used.

Various heating methods can be used for heating the preform 30 to the desired forming temperature (where the metal would be in a plastic state capable of flow forming). One particularly advantageous arrangement is illustrated in FIG. 1. There platens 40 and 42 are preferably made of ceramic material and provided with resistance heated wires 70. Heat from the resistance wires 70 is transmitted through the retort 12, base plate 14, tooling members 22, 24, 26, 28 and 32, and side blocks 34 to the preform 30. As to tooling members 22, 24, 26, 28, and 32 and side blocks 34 are also by this method heated to the forming temperature, the areas of the preform 30 contacted by these members during forming do not have their temperature substantially affected.

Where the preform 30 is made up of a metal or alloy which at temperatures required for flow forming would be subject to contamination, an environmental control system can be provided. Such a system would expose the preform 30 only to inert gas such as argon or a vacuum while heating and forming. The metal preform 30 will not react with the inert gas due to the nature of the inert gas, even at elevating forming temperatures. In a high vacuum, there are substantially no elements for the preform 30 to react with. Thus, in either environment, contamination of the metal preform 30 will be prevented.

To accomplish environmental control, a line 72 is connected through retort 12 to an aligned lateral conduit 74 in tooling frame member 16. A lateral conduit 76 extending through tooling member 28 connects with conduit 74. Lateral conduits 78 and 80, which are provided in members 26 and 24 respectively, are aligned with each other and conduit 76, but are spaced from one another and conduit 76 due to spaces 52 and 54. Longitudinal conduit 82 connects with conduit 76 and leads to chamber 36. Conduit 84, which is provided in tooling member 22, has a port 86 in alignment with conduit 80, though positioned in spaced relationship due to space 50 and a longitudinal portion 88 which leads to chamber 36.

Line 72 can be connected to a source (not shown) of vacuum and/or inert gas such that during heating and forming, air could be withdrawn from chamber 36, grooves 56, 58, and 60, and spaces 50, 52, and 54 to provide a substantially contamination free vacuum environment around preform 30. Additionally, if desired, after such withdrawal of air, inert gas could be provided to the aforementioned conduits to flow to said